US007365268B2

(12) United States Patent
Collins et al.

(10) Patent No.: US 7,365,268 B2
(45) Date of Patent: Apr. 29, 2008

(54) STORAGE RECEPTACLE

(75) Inventors: James E. Collins, Munster, IN (US); David J. Wojotowicz, Orland Park, IL (US); Anthony J. Troyner, Shorewood, IL (US); Mitchell S. Liss, Northbrook, IL (US)

(73) Assignee: Edsal Manufacturing Co., Inc., Chicago, IL (US)

( * ) Notice: Subject to any disclaimer, the term of this patent is extended or adjusted under 35 U.S.C. 154(b) by 0 days.

(21) Appl. No.: 11/263,484

(22) Filed: Oct. 31, 2005

(65) Prior Publication Data

US 2006/0144607 A1 Jul. 6, 2006

Related U.S. Application Data

(60) Provisional application No. 60/640,791, filed on Dec. 30, 2004.

(51) Int. Cl.
*H02G 3/08* (2006.01)

(52) U.S. Cl. ..... 174/50; 174/17 R; 174/58; 174/63; 439/535; 248/906

(58) Field of Classification Search ..... 174/50, 174/17 R, 58, 61, 63; 220/4.02; 439/535; 248/906; 403/13
See application file for complete search history.

(56) References Cited

U.S. PATENT DOCUMENTS

| | | | | |
|---|---|---|---|---|
| 1,483,453 | A * | 2/1924 | Knoderer | 220/3.94 |
| 2,552,400 | A * | 5/1951 | Brunia | 220/3.94 |
| 4,967,916 | A | 11/1990 | Handler et al. | |
| 5,703,327 | A * | 12/1997 | Jorgensen | 174/53 |
| 2002/0171338 | A1 | 11/2002 | Wetterberg | |

FOREIGN PATENT DOCUMENTS

| | | |
|---|---|---|
| DE | 29808396 U1 | 8/1998 |
| WO | 2005/074748 | 8/2005 |

OTHER PUBLICATIONS

Collins et al., *Shelving Connector*, filed Oct. 31, 2005, co-pending and commonly assigned U.S. Appl. No. 11/262,856 in its entirety.

* cited by examiner

*Primary Examiner*—Dhiru R. Patel
(74) *Attorney, Agent, or Firm*—Wood, Herron & Evans, LLP

(57) ABSTRACT

A storage receptacle is provided that has first and second sides and a bottom made as a unitary member from a single piece of sheet metal. The receptacle also includes front and rear ends, each coupled to the two sides and providing support for the bottom.

10 Claims, 6 Drawing Sheets

STORAGE RECEPTACLE

CROSS-REFERENCES

This application claims the priority benefit of U.S. Provisional Patent Application Ser. No. 60/640,791, "Shelving Connector", filed Dec. 30, 2004, which is expressly incorporated by reference herein in its entirety.

FIELD OF THE INVENTION

This invention relates to storage receptacles and more particularly, to storage receptacles that may be used to store personal items.

BACKGROUND OF THE INVENTION

A wide variety of storage receptacles are known in the art, including those that are suitably sized and configured to store relatively small personal items, as opposed to relatively large household goods, for various applications. For instance, storage receptacles of this type may be used to hold various personal items such as wallets, watches, car keys, etc. while the owner of these articles is utilizing the facilities within a sports or health club, for instance. In these instances, the storage receptacle is typically placed within a locker, and may be referred to as a locker bin.

Storage receptacles of this type may also be used to segregate personal items in a wide variety of other settings. For instance, students may find it useful to segregate various personal items in such receptacles inside their dorm room or apartment.

Storage receptacles of the aforementioned type are known to be fabricated from either plastic, metal or other suitable materials, which are selected for the particular application. As may be appreciated, metal receptacles of this type are typically stronger and less likely to be damaged during shipping or in use. However, some known metal receptacles may be subject to various disadvantages relative to plastic counterparts. For instance, while the plastic receptacles may be molded and thereby formed as a unitary construction, known metal receptacles are typically formed and assembled from five separate parts including two sides, two ends and a bottom, with the various components of the receptacle typically being joined by welding, other types of bonding such as brazing, or with the use of fasteners. Any of the foregoing means for assembling the various components of the metal receptacles add cost to the receptacle. Additionally, when discrete fasteners are used, the fasteners can increase cost and are also the source of aggravation where quantities are mishandled or the like.

Moreover, shipping of unitary units requires undue space waste, while later assembly of knock-down units is bothersome and can be attended by difficulties due to the noted fastener problem above or to out of tolerance manufacturing errors.

Additionally, although plastic receptacles are known in the art that are "stackable", the inventors are unaware of any metal receptacles of the foregoing type that may be stacked one upon another, in a secure manner.

It is thus desired to provide a storage receptacle of the type that may be used to contain relatively small personal items, that is strong and durable, yet is also cost efficient, easily assembled and is securely stackable.

SUMMARY OF THE INVENTION

To these ends, one aspect of the present invention is directed to a storage receptacle comprising first and second sides and a bottom, with the first and second sides and the bottom being made as a unitary member, or one piece construction, preferably from a single piece of sheet metal. The receptacle further includes front and rear ends made preferably of metal, with each end being coupled to the first and second sides and also providing support for the bottom.

In an illustrative embodiment, the front and rear ends each include a pair of flanges with a first one of the flanges being configured to overlap and be disposed generally parallel with one of the sides and a second one of each pair of the flanges being configured to overlap and be disposed generally parallel with the other of the sides.

The storage receptacle further comprises a plurality of openings formed in either the first and second sides at edges thereof, preferably proximate the front and rear ends of the sides, or in the flanges of the front and rear ends. A plurality of tabs are also provided. If the openings are formed in the first and second sides, then the tabs are formed in and extend from the flanges formed in the front and rear ends. In one embodiment, each opening has tapered sides for frictional engagement with substantially rectangular portions of aligned ones of the tabs to secure the sides to the front and rear ends of the receptacle.

A second aspect of the present invention is directed to methods of fabricating and assembling a storage receptacle having first and second sides, a bottom and front and rear ends, with the fabricating method comprising the step of working a single piece of substantially flat sheet metal stock to create the first and second sides and the bottom of the receptacle, with the bottom between and integral with the first and second sides. An assembly method further includes the steps of orienting the front and rear ends along edges of the erected integral bottom and sides and then moving the parts relatively to couple the first and second sides to the front and rear ends. Additionally, an assembly method according to the present invention includes the step of supporting the bottom of the receptacle with the front and rear ends of the receptacle.

In an illustrative embodiment, the step of fabricating the front and rear ends includes the steps of forming a pair of rearwardly extending flanges in the front end and similarly forming a pair of forwardly extending flanges in the rear end. In this instance, the step of coupling comprises the step of sliding the integral member onto the respective front and rear ends to couple the parts together. A further step includes this sliding step and the step of moving a bottom flange of each front and rear end toward the bottom of the integral member, supporting it when the parts are coupled.

One fabricating method of the present invention may further include the step of tapering either the openings or the tabs for frictional engagement with the other, when the sides are joined to the front and rear ends of the receptacle. In use, the sides and bottom of the receptacle are positioned so they are disposed inside of the flanges of the front and rear ends, with the openings and tabs aligned with one another. The tabs are then wedged within aligned ones of the openings to frictionally and securely join the ends and sides of the receptacle.

A third aspect of the present invention is directed to a corner member comprising a body portion having first and second wing portions and a central portion disposed between and integral with the wing portions. The wing portions are disposed at an angle relative to one another, which may be about 90 degrees. The corner member further includes a groove formed in the body portion and extending from a position below a top surface of the body portion to and through a bottom surface of the body portion. The corner member further includes an upstanding flange integral with the body portion and extending upwardly therefrom, with the upstanding flange and the top surface of the body portion defining a shoulder which is suitable to engage a lower corner of another like storage receptacle so that the storage receptacles may be stacked one upon another, with the lower members disposed between corners of stacked receptacles.

These and other advantages will be appreciated from the following written description and from the drawings in which:

DETAILED DESCRIPTION

Figure 1:
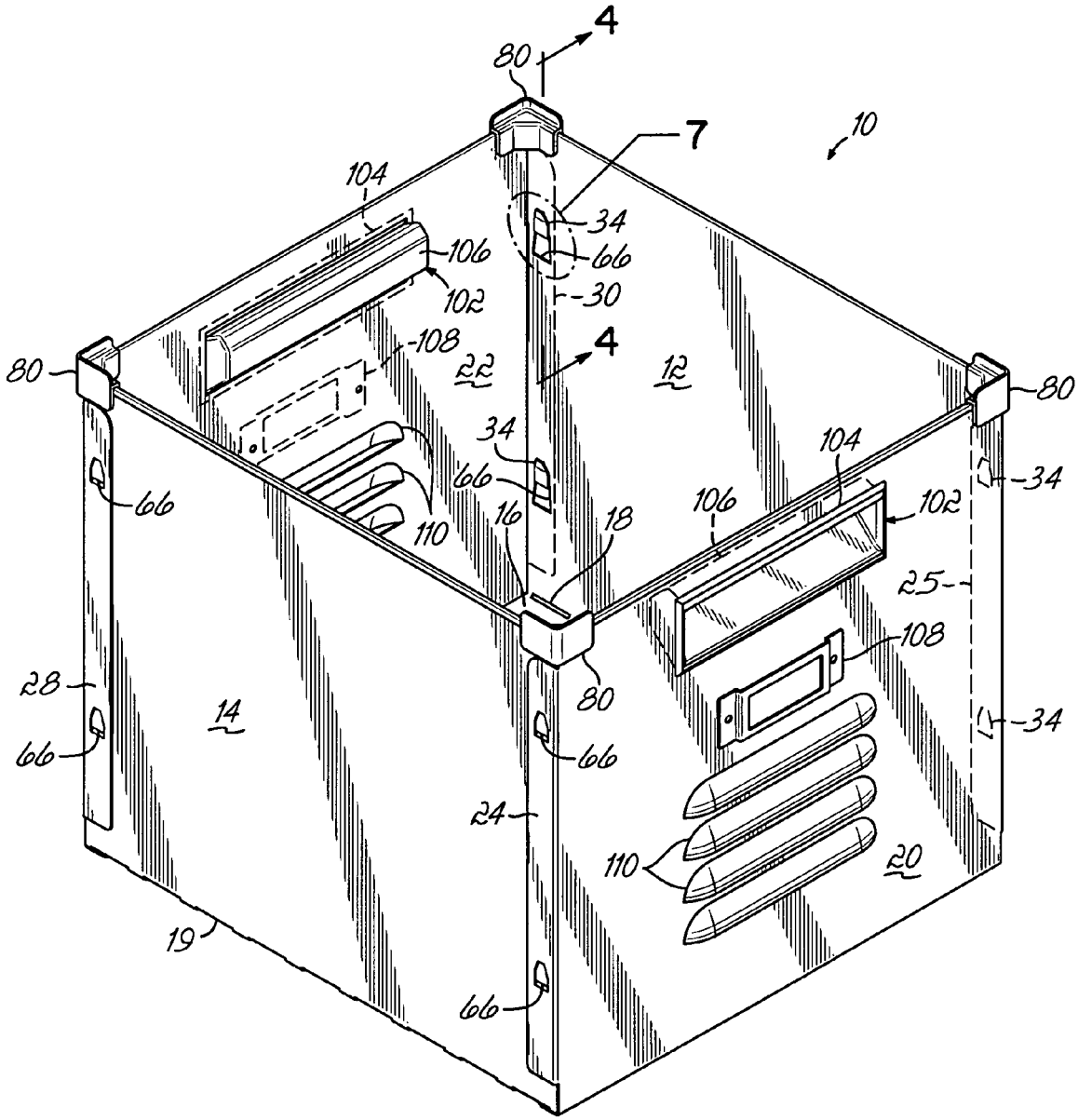
FIG. 1 is a perspective view of a storage receptacle according to the present invention.
Figure 2:
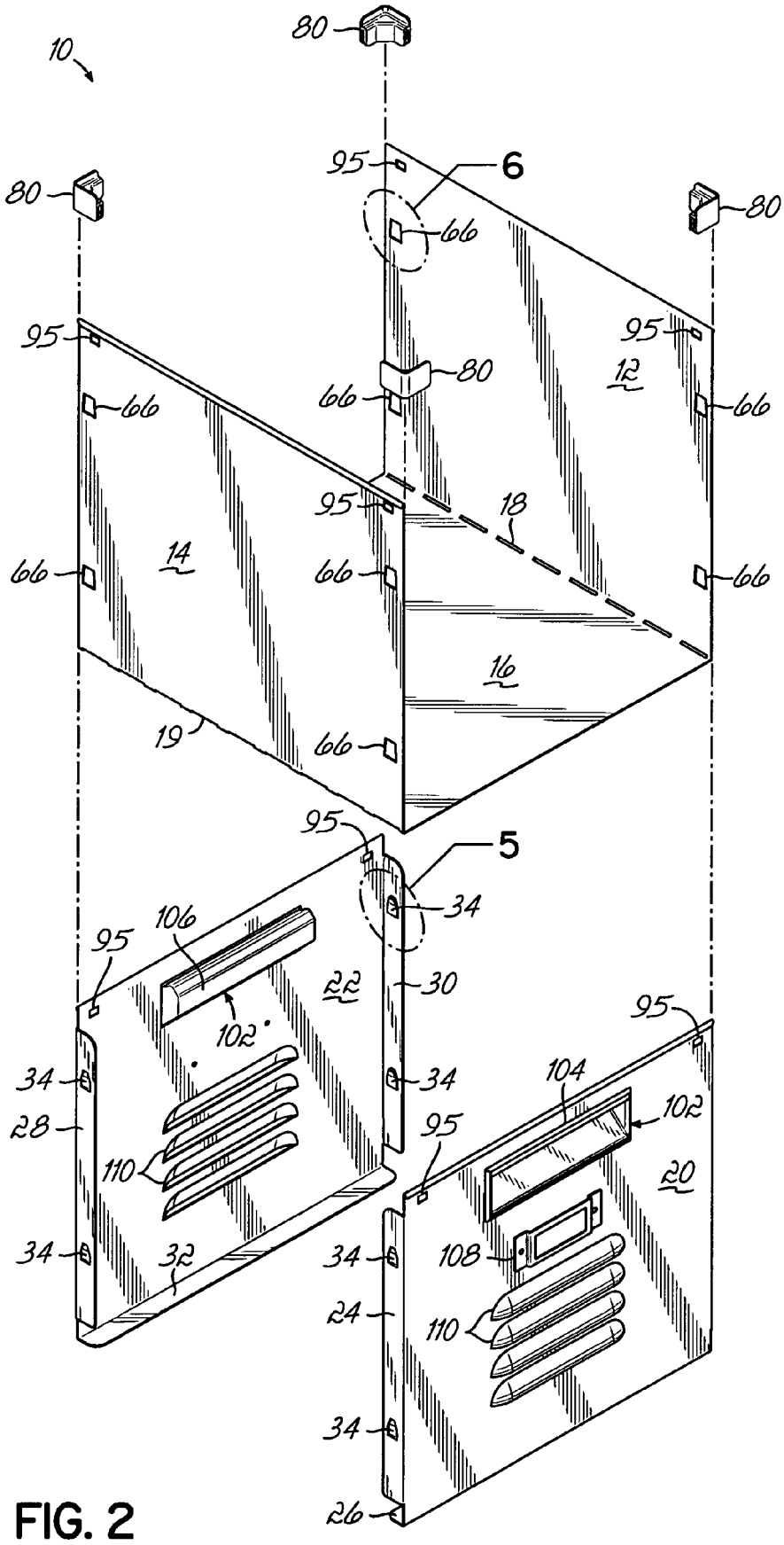
FIG. 2 is an exploded assembly view of the storage receptacle shown in FIG. 1.

FIG. 1 is a perspective view illustrating a storage receptacle 10 according to the present invention and FIG. 2 is an exploded assembly view of the storage receptacle 10 shown in FIG. 1. Storage receptacle 10 includes a first side 12, a second side 14 and a bottom 16. As best seen in FIG. 2, the bottom 16 extends between and is integral with sides 12 and 14. In a preferred embodiment, side 12, bottom 16 and side 14 are formed as a unitary or one piece member from a single piece of material such as flat sheet metal which is bent along a first line 18 and a second line 19 at opposite edges of the bottom so that the sides 12 and 14 are substantially orthogonally disposed relative to the bottom 16. The one piece member has a forward edge along both sides and bottom and an opposed rearward edge along both sides and bottom opposite the forward edge.

Receptacle 10 further includes front 20 and rear 22 ends, also preferably made of metal. As subsequently discussed in greater detail, the front 20 and rear 22 ends are coupled to the sides 12, 14 of the receptacle 10 and provide support for the bottom 16 of receptacle 10. Receptacle 10 has an open top so that items to be stored may be placed into and retrieved from receptacle 10.

The front end 20 includes a first rearwardly extending flange 24 integral with one side edge of the front end 20 and a second, similar rearwardly extending flange 25 integral with the other side edge of the front end 20. The front end 20 further includes a bottom flange 26 extending rearwardly from a bottom of the front end 20.

In a similar fashion, the rear end 22 of receptacle 10 includes a first flange 28 extending forwardly from a first side edge of the rear end 22 and a second flange 30 extending forwardly from the other side edge of the rear end 22. The rear end 22 also includes a forwardly extending bottom flange 32 as shown in FIG. 2. Flange 25 of front end 20 and flange 30 of the rear end 22 are disposed in overlapping and abutting relationship with side 12, and flange 24 of front end 20 and flange 28 of rear end 22 are disposed in overlapping and abutting relationship with side 14, when the sides 12, 14 are joined with the ends 20, 22.

The bottom flanges 26 and 32 of the front 20 and rear 22 ends, respectively, are disposed below and in overlapping and abutting relationship with the bottom 16 when receptacle 10 is assembled, so that the flanges 26 and 32 provide support for the bottom 16.

Side flanges 24 and 25 of the front end 20 and side flanges 28 and 30 of the rear end 22, each preferably include a plurality of integrally formed tabs 34.

Figure 5:
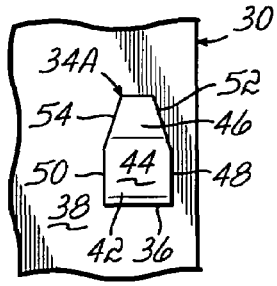
FIGS. 5 and 6 are enlarged views of the encircled areas of FIG. 2.
Figure 4:
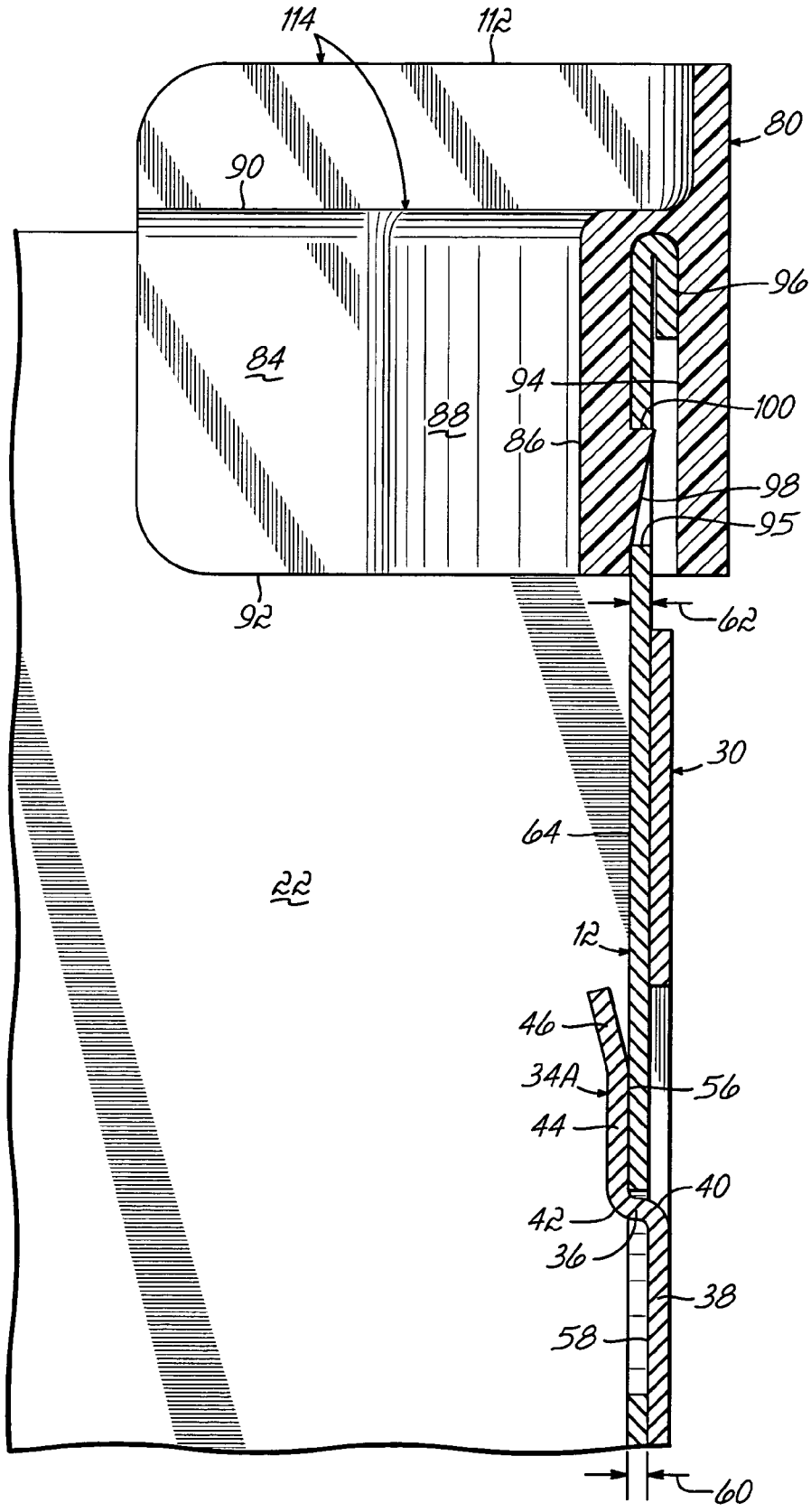
FIG. 4 is a cross-sectional view taken along line 4-4 in FIG. 1.

Referring now to FIGS. 4 and 5, the features of each of the tabs 34 will be illustrated with regard to a tab 34A that extends from the flange 30 of the rear end 22 of receptacle 10. Each of the tabs 34, such as tab 34A, include a proximal portion 36 that is integral with an adjacent, substantially planar portion of the corresponding flange. For instance, the proximal portion 36 of tab 34A is integral with a substantially planar portion 38 of flange 30. The proximal portion 36 includes a first bend portion 40 and a second bend portion 42 as shown in FIG. 4. Each tab 34 further includes an upwardly extending portion 44 integral with proximal portion 36 and an outwardly bent portion 46 integral with portion 44. In the illustrative embodiment, the upwardly extending portion 44 has a substantially rectangular shape, including substantially parallel sides 48 and 50, as best seen in FIG. 5. As also shown in FIG. 5, the outwardly bent portion 46 of each tab 34 includes tapered sides 52, 54 for subsequently described purposes.

Sides 12 and 14 each preferably include a plurality of openings, apertures or female connecting elements 66 formed therein. In the illustrative embodiment, four of the openings 66 are formed in each of the sides 12, 14 of receptacle 10, with two of the openings being disposed proximate the forward and rear edges of each of the sides 12 and 14. However, it is within the scope of the present invention to use different numbers of openings 66. Preferably, the number openings 66 is the same as the number of tabs 34 and the openings 66 are oriented within sides 12 and 14 so that the openings 66 are in register with the tabs 34 when the forward and rear ends 20, 22 are joined with the sides 12, 14.

Figure 6:
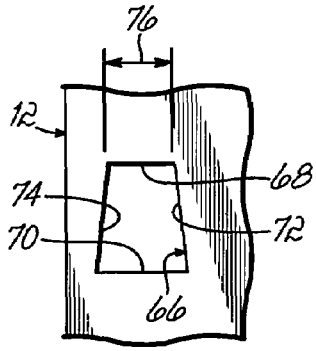
Figure 7:
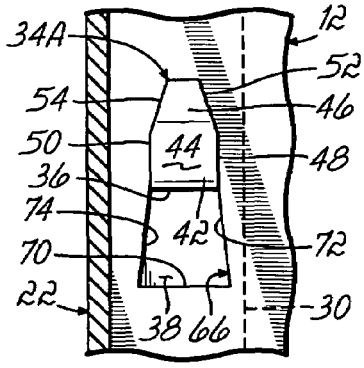
FIG. 7 is an enlarged view of the encircled area of FIG. 1.

Referring now to FIG. 6, in the illustrative embodiment the female connecting elements or openings 66 are inwardly tapered, from bottom to top. Each opening 66 has a top edge 68, bottom edge 70, and tapered sides 72, 74. The taper in one embodiment is slight, on the order of 0.010 inches so bottom edge 70 is about 0.010 inches longer than the top edge 68. In one embodiment, top edge 68 is 0.370 inches long and bottom edge 70 is 0.380 inches long. Any suitable taper can be used.

As best seen in FIG. 2, each of the openings 66 is disposed proximate a forward or rear end of one of the sides 12, 14, so the openings 66 may be positioned in register with tabs 34 formed in the flanges of the front 20 and rear 22 ends of receptacle 10, when the sides 12, 14 are joined with the ends 20, 22. In the illustrative embodiment, the width of the upwardly extending portion 44 of tab 34 is about equal to or slightly greater than a length 76 of the top edge 68 of opening 66, that extends between sides 72, 74 of opening 66.

The front 20 and rear 22 ends are joined to the sides 12, 14 of receptacle 10 by inserting the tabs 34 into openings or apertures 66, with the ends and sides moved relative to one another so that tabs 34 move upwardly in apertures 66. The insertion of tabs 34 into openings 66 is facilitated by the tapered sides 52, 54 of the outwardly bent portion 46 of each tab 34. This wedges the tabs 34 frictionally in the tapered apertures 66, holding the front 20 and rear 22 ends rigidly together with the sides 12, 14 of receptacle 10.

Referring again to FIG. 4, the relationship between tabs 34 and openings 66 is further illustrated with respect to tab 34A and one of the openings 66. The substantially flat surface 56 of portion 44 of tab 34A engages a substantially planar surface 64 of side 12, thus holding the side 12 and rear end 22 together securely. The opposite surface of side 12 is held against flange 30 of the rear end 22.

In a relaxed, free state condition, the configuration of bend portions 40, 42 causes the substantially flat, planar surface 56 of the upwardly extending portion 44 of tab 34A to be displaced from a surface 58 of the substantially planar portion 38 of flange 30 by a distance 60. Preferably, bend portions 40, 42 are configured so that distance 60 is less than a thickness 62 of side 12 of receptacle 10. Accordingly, when the receptacle 10 is assembled, a clamping force is applied between the substantially planar surface 56 of tab 34A and the substantially planar surface 64 of side 12. The magnitude of the clamping force can be varied by changing the configuration of bend portions 40, 42 to change distance 60 as may be appreciated.

In use, receptacles 10 according to the invention, can be shipped in a flattened condition. Upon assembly, the sides 12, 14 are folded along the edges joining them to bottom 16 into a U-shaped configuration. A front and rear end 20, 22 are oriented proximate the folded up sides 12, 14 and the parts are moved relative to each other in directions along the respective front and rear edges of sides 12, 14. The tabs 34 are directed into the openings 66 and into cooperative engagement to form the receptacle 10. Flanges 26, 32 of the front and rear ends 20, 22 move toward and engage bottom 16 to support it at the same time the parts are interengaged and coupled via the tabs 34 and openings 66.

The storage receptacle 10 further includes a pair of handles 102 that are inserted through generally rectangular openings formed in the front 20 and rear 22 ends of receptacle 10. Each handle 102 includes a frame 104 that is bonded or otherwise suitably attached to one of the ends 20, 22. Handle 102 also includes an inwardly protruding body portion 106 configured to accept the fingers of a person's hand, so that the storage receptacle 10 may be easily gripped for moving.

In the illustrative embodiment, the storage receptacle 10 optionally includes a name tag 108 suitably attached, such as by rivets or other acceptable means, to each of the ends 20, 22. The receptacle may also include additional name tags 108 attached to one or both of the sides of receptacle 10.

Figure 3:
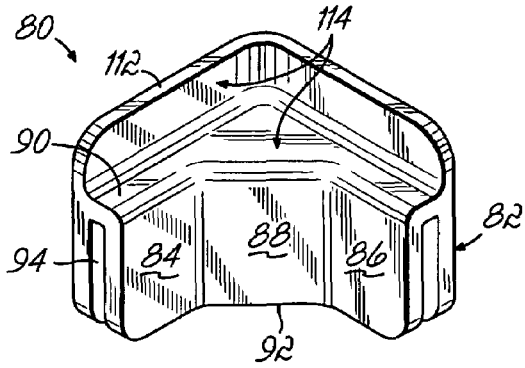
FIG. 3 is a perspective view of a corner member of the storage receptacle shown in FIG. 1.

A plurality of louvers 110 are formed in the front 20 and rear 22 ends of receptacle 10 to provide suitable ventilation, particularly when two or more of the receptacles 10 are stacked upon one another. A plurality of storage receptacles 10 of the present invention can be stacked, one atop the other, through the use of a plurality of corner members 80. Referring now to FIG. 3, corner member 80 includes a body portion 82 having first 84 and second 86 wing portions and a central portion 88 disposed between and integral with the first 84 and second 86 wing portions. The first and second wing portions 84, 86 are disposed at an angle relative to one another. In the illustrative embodiment, the angle between the first 84 and second 86 wing portions is substantially 90 degrees since receptacle 10 is shaped as a parallelepiped. In the illustrative embodiment, corner members 80 are made of a plastic material. Alternatively, corner members 80 may be made of rubber or other suitable, resilient material.

The body portion 82 of corner member 80 further includes a top surface 90 and a bottom surface 92. A groove 94 is formed in the body portion 82, with the groove 94 extending from a position somewhat below the top surface 90 to and through the bottom surface 92 of body portion 82. The groove 94 extends through the wing portions 84, 86 and the central portion 88 of body portion 82 so that the groove 94 may receive one of the sides 12, 14 and the adjacent one of the front 20 and rear 22 ends of receptacle 10. The configuration of the groove 94 is such that it is sufficiently wide at an upper end to accept a double thickness of a generally U-shaped top portion of one of the sides and ends, as illustrated in FIG. 4 with respect to a U-shaped portion 96 of the side 12. The configuration of the lower portion of the groove 94 is somewhat irregular since corner member 80 also includes a pair of ramps 98 (one shown in FIG. 4) which protrude into groove 94. After the sides 12, 14 have been secured to ends 20, 22 of receptacle 10, each corner member 80 is then positioned over one of the corners so that the groove 94 is in register with the corresponding one of the sides and ends of receptacle 10. As each corner member 80 is pushed downwardly, a double thickness, upper lip portion of the corresponding side and end is forced into an upper portion of the groove 94 of each member 80. Once an upper lip 100 of each ramp 98 passes below an upper edge of the corresponding slot 95, the ramp 98 snaps into the slot 95 due to the resilient nature of corner member 80. FIG. 4 illustrates the engagement of one of the ramps 98 of the depicted corner member 80 into one of the slots 95 in side 12. In this position, the upper lip 100 of the ramp 98 is disposed in abutting relationship with the upper edge of the slot 95, thereby securing corner member 80 to side 12.

Figure 8:
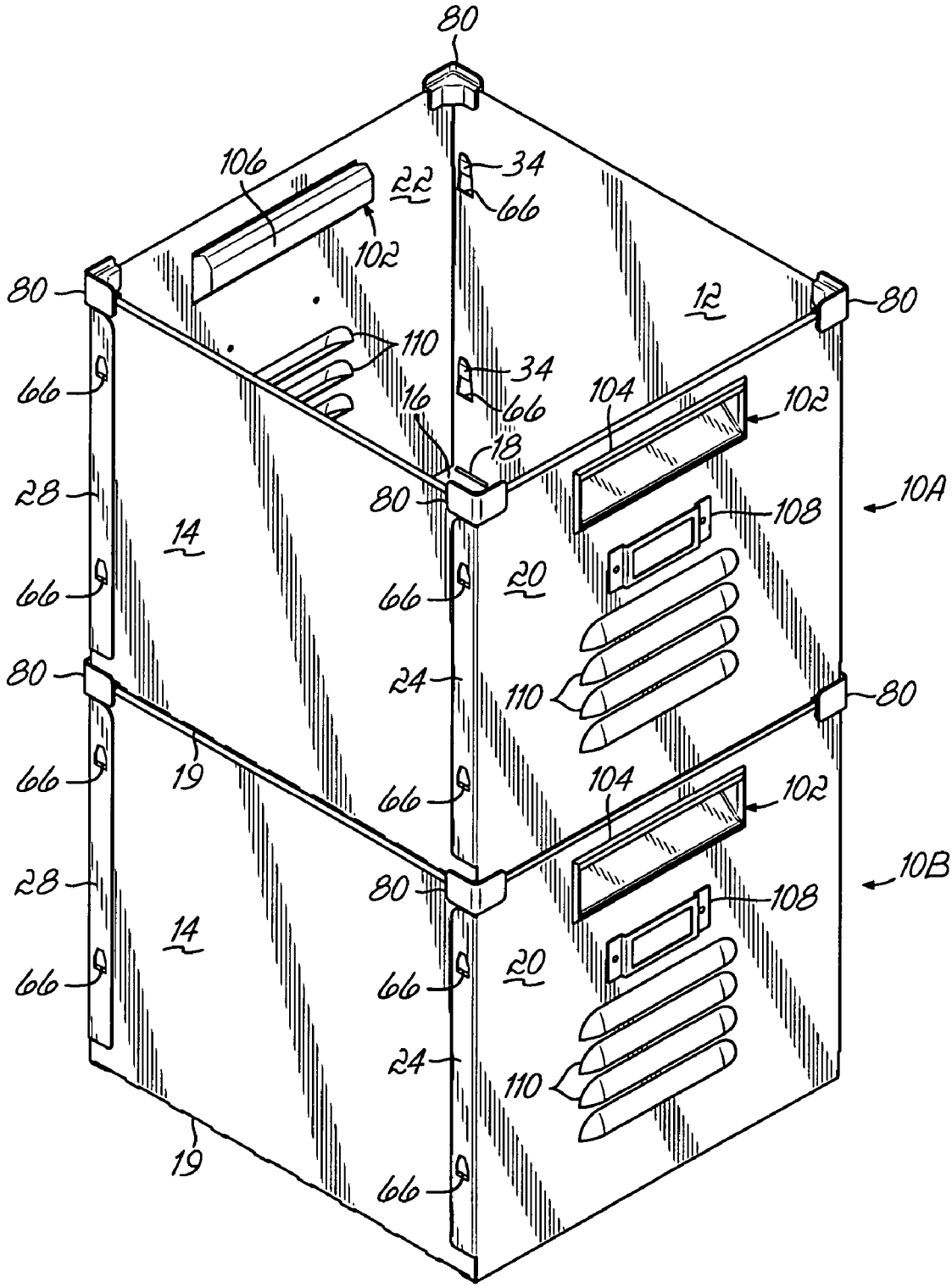
FIG. 8 is a perspective view illustrating two storage receptacles of the present invention in stacked relationship with one another.

Corner member 80 also includes an upstanding flange 112 that is integral with the body portion 82 and extends upwardly therefrom at a position outside of groove 94. The upstanding flange 112 and the top surface 90 of the body portion 82 of member 80 define a shoulder 114. The shoulder 114 and flange 112 are sized and configured so that a plurality of receptacles 10 may be stacked one upon another. This is illustrated in FIG. 8 with regard to receptacles 10A and 10B.

While the foregoing description has set forth preferred embodiments to the present invention in particular detail, it must be understood that numerous modifications, substitutions and changes can be undertaken without departing from the true spirit and scope of the present invention as defined by the following claims. For instance, although the illustrated tabs 34 include a generally rectangular and upwardly extending portion 44 wedged into a trapezoid shaped opening 66, alternately, the rectangular portion 44 of tabs 34 may be replaced with a portion having tapered sides for fitting in a rectangular opening, thus still obtaining the frictionally wedging action. Also, the previously described wedging action may be accomplished with openings and tabs having other shapes that are considered to be within the scope of the present invention. It will be appreciated that the tabs 34 and openings 66 can be respectively formed along edges or in the flanges of the integral bottom and side members or in the front and rear end members, the preferred construction described here as a preferable but non-limiting embodiment.

Figure 2A:
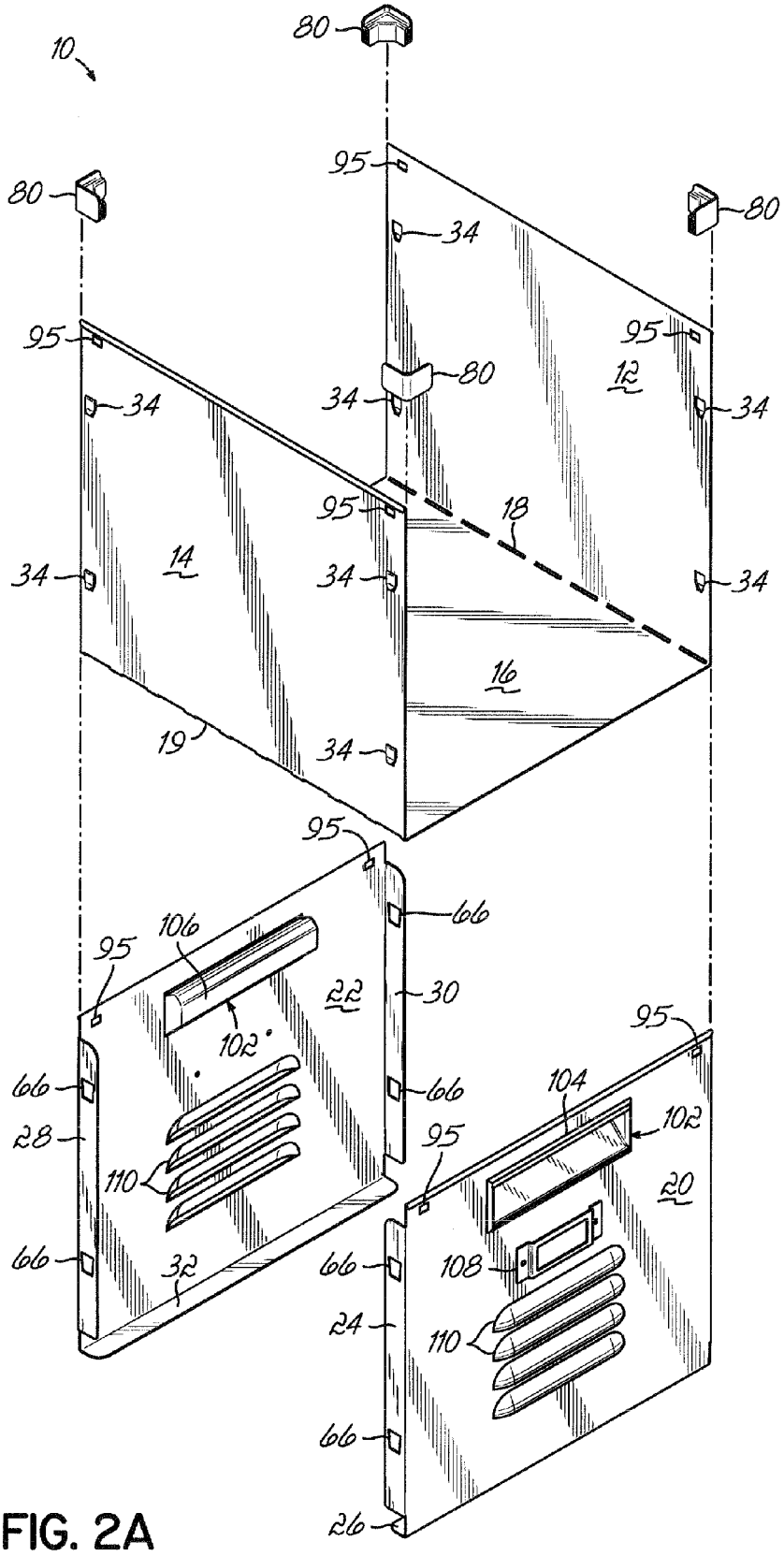
FIG. 2A is an exploded assembly view similar to FIG. 2, illustrating an alternate embodiment with regard to the included tabs and openings of the storage receptacle shown in FIG. 1.

FIG. 2A illustrates one alternate embodiment wherein the tabs 34 are formed in the sides 12 and 14 of receptacle 10 and the openings 66 formed in the front 20 and rear 22 ends. Furthermore, while corner members 80 have been illustrated as part of receptacle 10, corner members 80 may be advantageously utilized with other structures. It will be further appreciated that other modifications and advantages will be readily appreciated by those of ordinary skill without departing from the scope of this invention and applicant intends to be bound only by the claims appended hereto.

What is claimed is:

1. A storage receptacle comprising:

first and second sides and a bottom, said first and second sides and said bottom being made as a unitary member from a single piece of sheet metal;

front and rear ends, each of said front and rear ends being coupled to said first side and said second side, wherein said front and rear ends each include a pair of flanges, a first one of each of said pair of said flanges being configured to overlap and be disposed in generally parallel relationship with one of said sides, a second one of each of said pair of said flanges being configured to overlap and be disposed in generally parallel relationship with the other of said sides;

a plurality of openings formed in one of said first and second sides and said flanges of said front and rear ends; and a plurality of tabs extending from the other of said first and second sides and said flanges of said front and rear ends; wherein each of said tabs are aligned with and inserted into one of said openings, wherein said sides are coupled to said front and rear ends.

2. A storage receptacle as recited in claim 1, wherein:

one of said openings and said tabs are tapered for frictional engagement with aligned ones of the other of said openings and said tabs when said sides are coupled to said front and rear ends.

3. A storage receptacle as recited in claim 1, wherein:

said front end includes a rearwardly extending bottom flange; said rear end includes a forwardly extending bottom flange; and said bottom flanges are disposed below and in overlapping and abutting relationship with said bottom, thereby supporting said bottom.

4. A storage receptacle as recited in claim 1, wherein:

said front and rear ends are made of metal.

5. A corner member comprising:

a body portion having first and second wing portions and a central portion disposed between and integral with said first and second wing portions, said first and second wing portions being disposed at an angle relative to one another, said body portion further including top and bottom surfaces;

a groove formed in said body portion, said groove extending from a position below the top surface of said body portion to and through the bottom surface of said body portion;

an upstanding flange integral with said body portion and extending upwardly therefrom, said upstanding flange and said top surface of said body portion defining a shoulder.

6. A corner member as recited in claim 5, wherein;

said angle between said first and second wing portions of said body portion is about 90 degrees.

7. A corner member as recited in claim 6, further comprising:

at least one ramp protruding into said groove;

said groove being operatively effective for receiving a corner portion of a structure, said ramp being operatively effective for snapping into a slot formed in the structure.

8. A corner member as recited in claim 5, wherein:

said upstanding flange extends upwardly at a position outside of said groove.

9. A corner member as recited in claim 5, wherein:

said corner member is made of a resilient material.

10. A multiple bin storage receptacle comprising:

a first storage bin having front and rear ends and two sides of sheet metal and a bottom of sheet metal, said sides and said ends defining corners at an upper open end of said first storage bin;

a second storage bin having four sides of sheet metal and a bottom of sheet metal, said sides of said second storage bin and said bottom of said second storage bin defining corners at a closed lower end of said second storage bin;

a plurality of corner members each having a shoulder for engaging said corners of said second storage bin and a groove for engaging said corners of said first storage bin;

said second storage bin disposed above said first storage bin and on said corner members disposed at said corners of said first storage bin.

* * * * *